US005692238A

United States Patent [19]

Watson, Jr.

[11] Patent Number: 5,692,238

[45] Date of Patent: Dec. 2, 1997

[54] BODY COMFORTER

[76] Inventor: Jerry O. Watson, Jr., 1235 Nebraska Ave., Kansas City, Kans. 66102

[21] Appl. No.: 667,228

[22] Filed: Jun. 19, 1996

[51] Int. Cl.[6] ..... A41D 1/04

[52] U.S. Cl. ..... 2/102; 2/170; 2/DIG. 11; 607/108

[58] Field of Search ..... 2/102, 69, 7, 458, 2/DIG. 11, 170, 209.13, 94, 243.1; 374/161, 162, 160; 607/108, 109, 111, 112, 114; 62/259.3

[56] References Cited

U.S. PATENT DOCUMENTS

| | | | |
|---|---|---|---|
| 710,429 | 10/1902 | Collins et al. . | |
| 3,084,241 | 4/1963 | Carrona . | |
| 3,648,764 | 3/1972 | Starr | 73/362 R |
| 3,648,765 | 3/1972 | Starr | 165/39 |
| 3,830,224 | 8/1974 | Vanzetti et al. | 128/2 H |
| 4,138,889 | 2/1979 | Fraschini | 73/356 |
| 4,170,998 | 10/1979 | Sauder | 128/400 |
| 4,198,861 | 4/1980 | Mung-Kuen Luk | 73/356 |
| 4,302,971 | 12/1981 | Luk | 73/356 |
| 4,538,926 | 9/1985 | Chretien | 347/150 |
| 4,625,729 | 12/1986 | Roney | 607/108 |
| 4,930,317 | 6/1990 | Klein | 62/3.3 |
| 5,038,779 | 8/1991 | Barry et al. | 128/402 |
| 5,072,455 | 12/1991 | St. Ours | 2/102 |
| 5,146,625 | 9/1992 | Steele et al. | 73/356 |
| 5,200,736 | 4/1993 | Coombs et al. | 2/5 |
| 5,243,706 | 9/1993 | Frim et al. | 2/102 |
| 5,305,470 | 4/1994 | McKay | 2/7 |
| 5,305,471 | 4/1994 | Steele et al. | 2/102 |
| 5,366,491 | 11/1994 | Ingram et al. | 607/108 |
| 5,389,093 | 2/1995 | Howell | 604/361 |
| 5,415,222 | 5/1995 | Colvin et al. | 2/102 |
| 5,524,293 | 6/1996 | Kung | 2/102 |

*Primary Examiner*—Amy B. Vanatta

*Attorney, Agent, or Firm*—Patent & Trademark Services, Inc.; Joseph H. McGlynn

[57] ABSTRACT

A garment having pockets or other enclosures capable of mounting cooling packs such as gel packs therein. Thermally sensitive indicators, such as sensitive color gauge strips, are used to display the packs current effective temperatures. Thermal garment openings allow the packs to transmit cold to a user while the thermal indicators inform the user if the packs are too cold or too warm to be effective. Many different types of garments may utilize the principles behind this invention including headbands, wristbands and body vests.

8 Claims, 1 Drawing Sheet

BODY COMFORTER

BACKGROUND OF THE INVENTION

The present invention relates to a cooling apparatus used to transfer heat from a person's body to cooler gel packs. These gel backs can be enclosed in a variety of different wearable garments such as a headbands, vests or wristbands. A strip type thermometer attached to the gel backs informs a wearer when the gel packs are beyond their effective temperature.

DESCRIPTION OF THE PRIOR ART

In the prior art various types of wearing apparatus are disclosed which utilize gel or cooling packs to cool a user. A vest with pockets is disclosed in the U.S. Pat. Nos.: 5,038,779 to Barry et al, 5,146,625 to Steele et al. and 5,305,471 to Steele et al. with gel packs or thermal control packers inserted in their pockets. In the U.S. Pat. No. 5,305,470 to McKay a sports band or headband has a slit to allow a flexible cold back to be inserted. And in still other inventions(U.S. Pat. Nos. 4,138,889 to Franschini, 4,198,861 to Luk, 4,302,971 to Luk and 4,538,926 to Charetien) strip type thermometers are used to measure a person's body temperature. None of these inventions, however, utilize the cooling effects of gel backs in garments while also informing a user of the gel pack's effective temperature.

SUMMARY OF THE INVENTION

The present invention consists of a cooling garment with removable gel packs with thermal sensitive indicators to alert users that the packs or either too cold or warm. The packs and thermal indicators may be mounted in garments such as headbands or wristbands with a series of openings to allow direct exposure of the packs to the user's skin. When different sized vests are the cooling garment, each has a series of gel packet containing pockets with thermal openings and at least one thermal indicator.

It is an object of the present invention to provide an improved cooling garment.

It is a further object of the present invention to provide a cooling garment with a least one thermal sensitive indicator to inform a user whether contained cooling packs are effectively operating.

It is another object of the present invention to provide such a garment with gel pack containing pockets and hoop and loop fasteners.

These and other objects and advantages of the present invention will be fully apparent from the following description, when taken in connection with the annexed drawings.

DESCRIPTION OF THE PREFERRED EMBODIMENT

Figure 1:
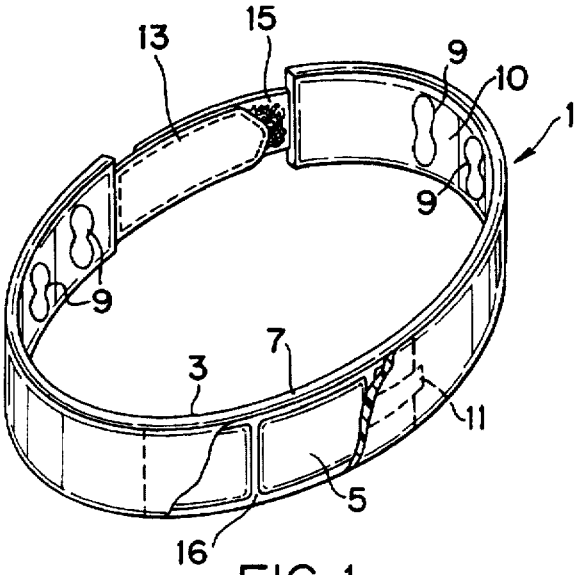
FIG. 1 show the present invention in a headband.

Referring now to the drawings in greater detail, FIG. 1 shows the invention embodied in a two material layer headband 1. A center opening 3 extends around the headbands to allow the insertion or removal of gel packs 5 into or from the headband. These packs are shown in place in the cut away headband's section. To secure the packs in place a loop and hook closure 7 is used, such as found in a VELCRO™ material, along the inner lip of the opening 3. On the inside of the headband facing a user's skin is a series of spaced thermal openings 9 which allow the gel packs indirect exposure to a user's skin. The headband's inner material layer 10 contains the openings and touches the user and acts to separate the packs from the user. A thermal sensitive color gauge strip 11 is mounted along the headband's inside to display the current gel pack temperature by use of a gauge. This gauge's colored reading advises a user that the packs are either too cold or too warm to be effective. To see the displayed gauge a user would remove the headband. One manufacturer that supplies such color gauge thermometers is the American Thermometer Company of Huber Height Ohio 45424.

Loop and hook material, such as found in a VELCRO™ material, is used with the overlapping flaps 13 and 15 to fasten the headband to a user's head. The circular seam extending around the headband can be ultrasonically welded to insure that the packs remain in place between the headband's two layers.

The gel packs used in the different embodiments of the invention are Propylene Glycol packs which can removed from a garment for cleaning or for re-cooling. Normally all of the other garment components are either single or multi-layered colored nylon and urethane polyester.

Figure 2:
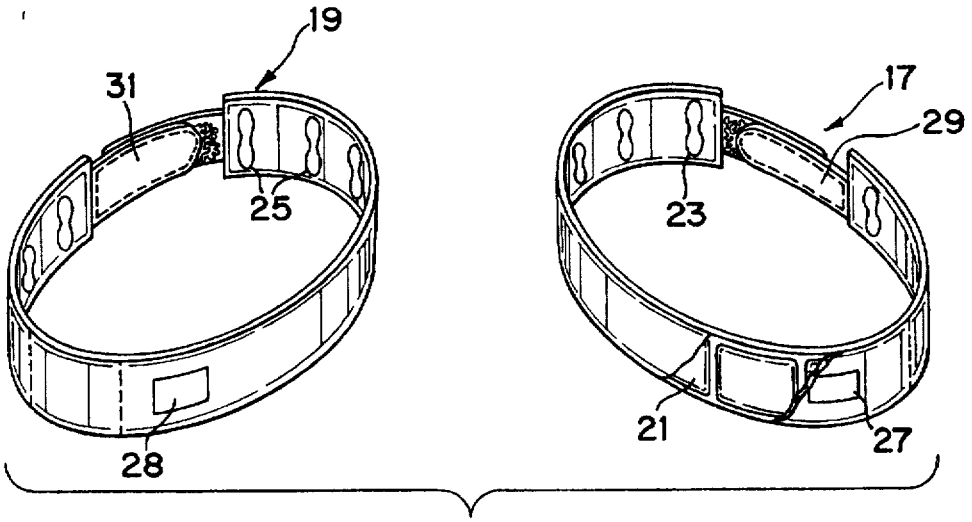
FIG. 2 is another embodiment of the invention used in two wristbands.

FIG. 2 shows two wristbands 17 and 19 embodying my invention. Each is similar to the headband in that each wristband has its own gel packs 21 (shown in wristband 17), thermal openings (23 and 25), outside mounted thermal sensitive color gauge strips (shown as 27 and 28) and hoop and loop closures 29 and 31. Typically these wristbands have two layers of material and are approximately 13" in length and 3 inches wide.

Figure 3:
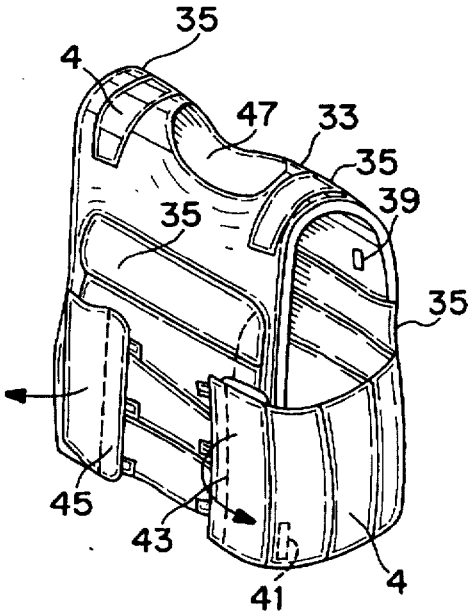
FIG. 3 depicts the invention embodied in a vest.

The FIG. 3 vest 33 embodiment comes in three sizes. The large version incorporates thirteen pockets 35 each capable of holding a gel pack 37. An extra large vest version has seventeen cooler pockets and a still large version(extra extra large) would incorporate twenty three cooler pockets. Each pocket has a thermal opening 39 for its contained gel pack. Thermal sensitive color gauge strips 41 are mounted inside the vest's hook and loop closure fasteners and inside the vest's flaps 43 and 45. The thermal sensitive strips are viewed and read by opening the vest's flaps in the direction of the shown arrows.

Clearly the size, shape and number of the gel packs would vary depending on the particular garment in which embodied. These packs are placed in a conventional freezer unit and, when frozen, placed in the garment pockets or other garment closures. The garment is then attached to the user with the loop and hook closures. With the vest embodiment the user places his or her head through opening 47 and wraps the back mounted flaps around his or her side and secures the flaps together.

Garments cooled with gel packs help a user avoid heat exhaustion during exercise or strenuous work and prevent the loss of fluids due to perspiration, thus allowing a user to work in a hot or humid environment for longer time periods. The color gauge strip thermometers fitted with each embodiment allow the optimum use of the invention as too cold packs cause discomfort and too warm packs loose their ability to cool effectively.

The primary synthetic material used to make each of these garments is assembled from patterns and sewn together with conventional industrial sewing machines. The plastic gel or Glycol packs are manufactured by electrosonically welding sheet plastic together on three side, then filling the pack with the Glycol liquid and sealing the fourth side. Electronic welding of plastic seams is preferred over conventional "heat bar" welding because it provides a stronger, more leak-proof weld. Ultrasonic plastic welding is accomplished by vibrating a metal "horn" so fast that heat is generated throughout the material being welded by sheer friction. Since the vibrations saturate the plastic being welded, all of the plastic becomes equally and evenly hot providing a very uniform solid weld.

The color changing strips used to indicate temperature are sometimes called "Liquid Crystal" thermometers, and are available off the shelf from a variety of commercial sources such as the mentioned American Thermometer Company of Huber Height, Ohio. As the temperature increases the color expands and a gauge reading tells the user of this increase. Conversely, a temperature decrease results in a contraction of the colored gauge to visually show less color and a smaller gauge reading.

Clearly, my invention is not limited to the three garments embodiments shown. Almost any type of wearable garment such as headgear, limb gear or any other body gear could also utilize the principles behind my invention. In particular sportswear, like football helmets, when used in strenuous hot climates would find my invention very useful. It also could be used in cooling garments in nursing homes where users do always communicate their condition to the caregivers.

Although the BODY COOLER and the method of using the same according to the present invention has been described in the foregoing specification with considerable details, it is to be understood that modifications may be made to the invention which do not exceed the scope of the appended claims and modified forms of the present invention done by others skilled in the an to which the invention pertains will be considered infringements of this invention when those modified forms fall within the claimed scope of this invention.

What I claim as my invention is:

1. A garment having removable gel cooling packs comprising:

a garment with separate mounts for permitting the mounting of individual separate gel cooling packs in each separate mount;

a plurality of separate individual removable gel cooling packs one of which can be insertable into each of the garment's separate mounts; and at least one thermal sensitive indicator mounted on said garment associated with a specific gel cooling pack to visually indicate the temperature of that cooling pack and to permit a determination of its current temperature effectiveness.

2. The invention as claimed in claim 1, wherein said garment is a headband having inner spaced thermal openings facing towards a user and located adjacent to any inserted cooling packs.

3. The invention as claimed in claim 2, wherein said thermally sensitive indicators are color gauge strips mounted on the inside of the headband which visually display the current cooling pack temperature.

4. The invention as claimed in claim 1, also including at least one loop and hook fastener to hold the garment to a user.

5. The invention as claimed in claim 1, wherein said garment is a wristband having said thermally sensitive indicator mounted on the outside thereof.

6. The invention as claimed in claim 5, also including a loop and hook fastener to hold the wristband to a user's wrist.

7. The invention as claimed in claim 1, wherein said garment is a body vest having thermal openings and thermally sensitive indicators mounted on it to indicate the temperature of any mounted cooling packs.

8. The invention as claimed in claim 7, also including a loop and hook fastener to hold the vest to a user.

* * * * *